US007726825B2

(12) United States Patent
Mandapat et al.

(10) Patent No.: US 7,726,825 B2
(45) Date of Patent: Jun. 1, 2010

(54) LIGHTED POWER OUTLET SYSTEM AND METHOD

(75) Inventors: Denny Mandapat, Chula Vista, CA (US); Sural Yegin, Chula Vista, CA (US); Carlos Ramirez, Chula Vista, CA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 12/035,801

(22) Filed: Feb. 22, 2008

(65) Prior Publication Data

US 2009/0213567 A1 Aug. 27, 2009

(51) Int. Cl.
*F21V 33/00* (2006.01)

(52) U.S. Cl. ..... 362/95; 361/118

(58) Field of Classification Search ..... 361/118; 362/95

See application file for complete search history.

(56) References Cited

U.S. PATENT DOCUMENTS

| | | | | |
|---|---|---|---|---|
| 2,189,676 | A * | 2/1940 | Pfohl | 200/310 |
| 2,612,597 | A * | 9/1952 | Sherrard | 362/560 |
| 3,265,888 | A * | 8/1966 | Adolphson, Jr. | 362/95 |
| 5,883,445 | A * | 3/1999 | Holman | 307/38 |
| 6,109,760 | A | 8/2000 | Salatrik et al. | |
| 6,827,602 | B2 | 12/2004 | Greene et al. | |
| 6,857,760 | B2 | 2/2005 | Chien | |
| 7,004,595 | B1 * | 2/2006 | Stoddard | 362/95 |
| 7,011,422 | B2 | 3/2006 | Robertson et al. | |
| 7,036,948 | B1 * | 5/2006 | Wyatt | 362/95 |
| 7,086,892 | B2 | 8/2006 | Tanacan et al. | |
| 7,121,707 | B2 * | 10/2006 | Currie et al. | 362/555 |
| 7,168,974 | B2 | 1/2007 | Feldman et al. | |
| 2005/0124209 | A1 * | 6/2005 | Currie et al. | 439/490 |
| 2007/0193866 | A1 | 8/2007 | Eder et al. | |
| 2009/0141477 | A1 * | 6/2009 | Bhosale et al. | 362/95 |

* cited by examiner

*Primary Examiner*—Ronald W Leja
(74) *Attorney, Agent, or Firm*—Davis Wright Tremaine LLP; George C. Rondeau, Jr.; Heather M. Colburn

(57) ABSTRACT

A lighted power outlet system having a plurality of outlets includes light emitters, such as light emitting diodes or other light emitting devices. The light emitters are internally positioned within the interior of the outlet system so that light is projected through terminal apertures of the outlets. The projected light is visible from locations exterior to the outlet system to assist in guiding alignment of plug prongs with the terminal apertures for engagement of electrical plugs with the outlets of the outlet system.

31 Claims, 8 Drawing Sheets

LIGHTED POWER OUTLET SYSTEM AND METHOD

BACKGROUND OF THE INVENTION

1. Field of the Invention

The present invention is directed generally to electrical power outlets.

2. Description of the Related Art

Electrical power outlets, such as found in electrical power strips, are fashioned to receive plugs that terminate electrical cords or other electrical transmission media to furnish electrical power to equipment or other devices. Engagement of the plugs with the power outlets requires spatial alignment of plug prongs with terminal apertures of the outlets and then subsequent insertion of the plug prongs therein. Such engagement procedures can be problematic in dimly lit areas and/or areas that have other challenging visual acuity issues.

BRIEF DESCRIPTION OF THE SEVERAL VIEWS OF THE DRAWING(S)

DETAILED DESCRIPTION OF THE INVENTION

A lighted power outlet system and method is present herein to include light emitters, such as light emitting diodes or other light emitting devices. The light emitters are internally positioned within the interior of the outlet system so that light is projected through the terminal apertures of the outlets. The projected light is visible from locations exterior to the outlet system to assist in guiding alignment of plug prongs with terminal apertures for engagement of electrical plugs with outlets of the outlet system.

Figure 1:
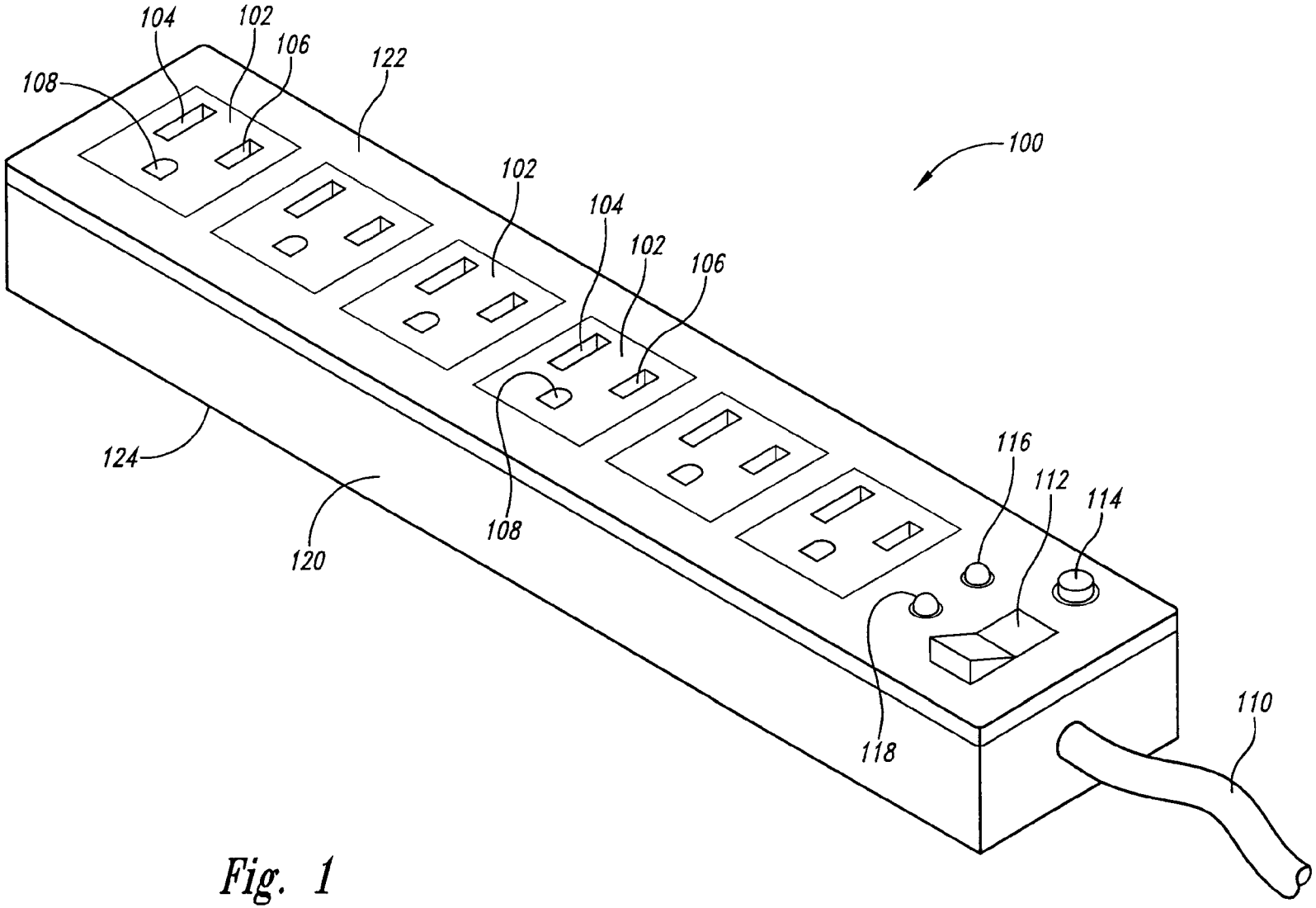
FIG. 1 is a front perspective view of a lighted power outlet system according to the present invention.

A light power outlet system 100 is depicted in FIG. 1 as including a plurality of outlets 102 each having a neutral terminal aperture 104, a positive terminal aperture 106, and a ground terminal aperture 108. The outlet system 100 receives electrical power from a supply cable 110 to be distributed through the outlets 102 to devices (not shown) that are coupled thereto. In the depicted implementation, the outlet system 100 has a power switch 112 with on and off positions (shown in the off position in FIG. 1). When the power switch 112 is in the off position no electrical power is available to the outlets 102 so that devices coupled to the outlets are not furnished electrical power by the outlet system 100. When the power switch 112 is in the on position (shown in FIG. 3 and discussed further below) electrical power is available to the outlets 102 so that devices coupled to the outlets are furnished electrical power by the outlet system 100.

In the depicted implementation, the outlet system 100 further includes a reset and/or fuse 114, a surge protection indicator 116, and a polarity and/or ground indicator 118 all of which can be optional accessories with other implementations. The outlet system 100 further includes a housing 120 to provide protection and/or aesthetic functionality for internal components housed therein. For illustration purposes, the outlet system is depicted as having a front side 122 and a backside 124.

Figure 2:
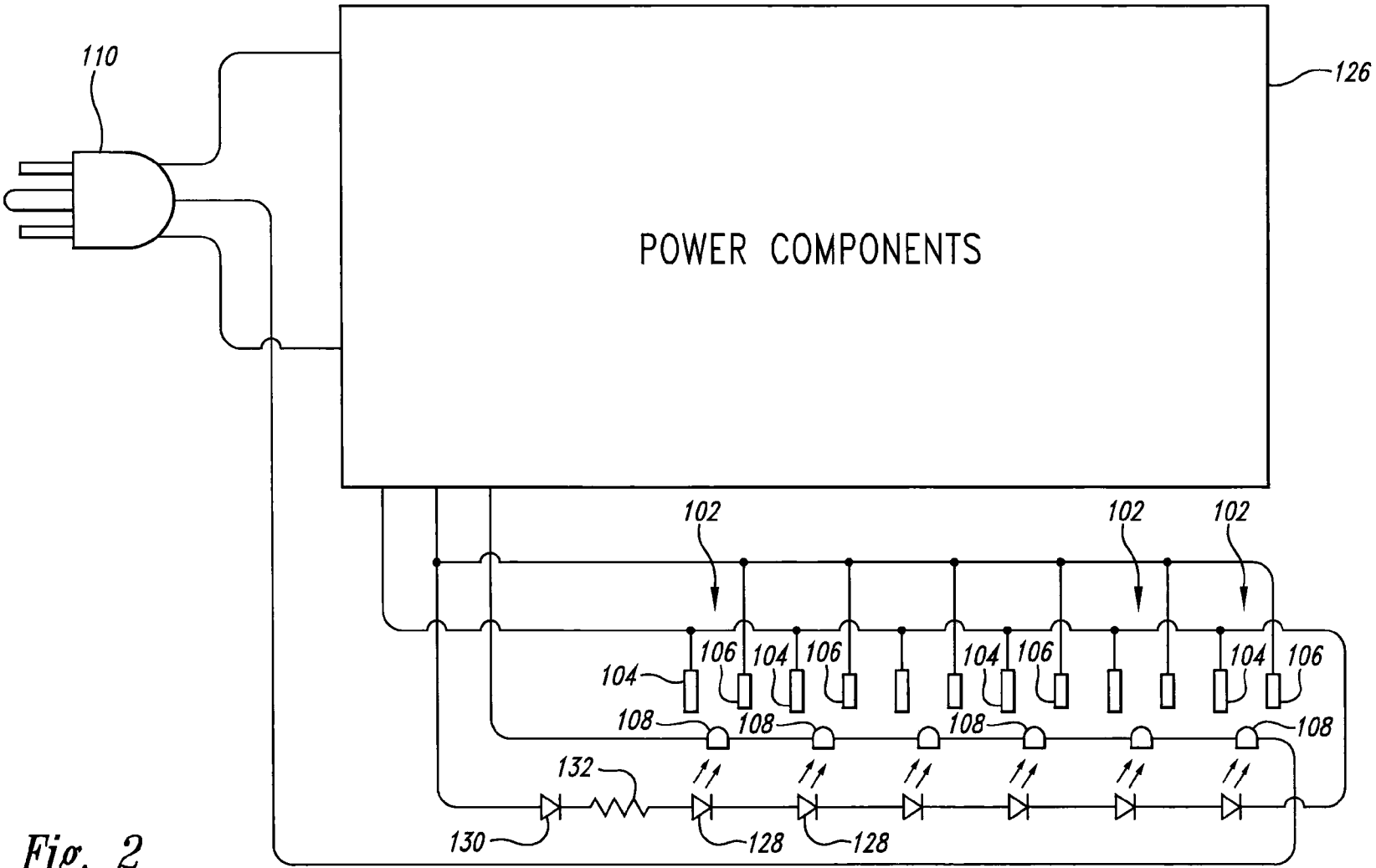
FIG. 2 is a schematic diagram of the outlet system of FIG. 1.
Figure 2A:
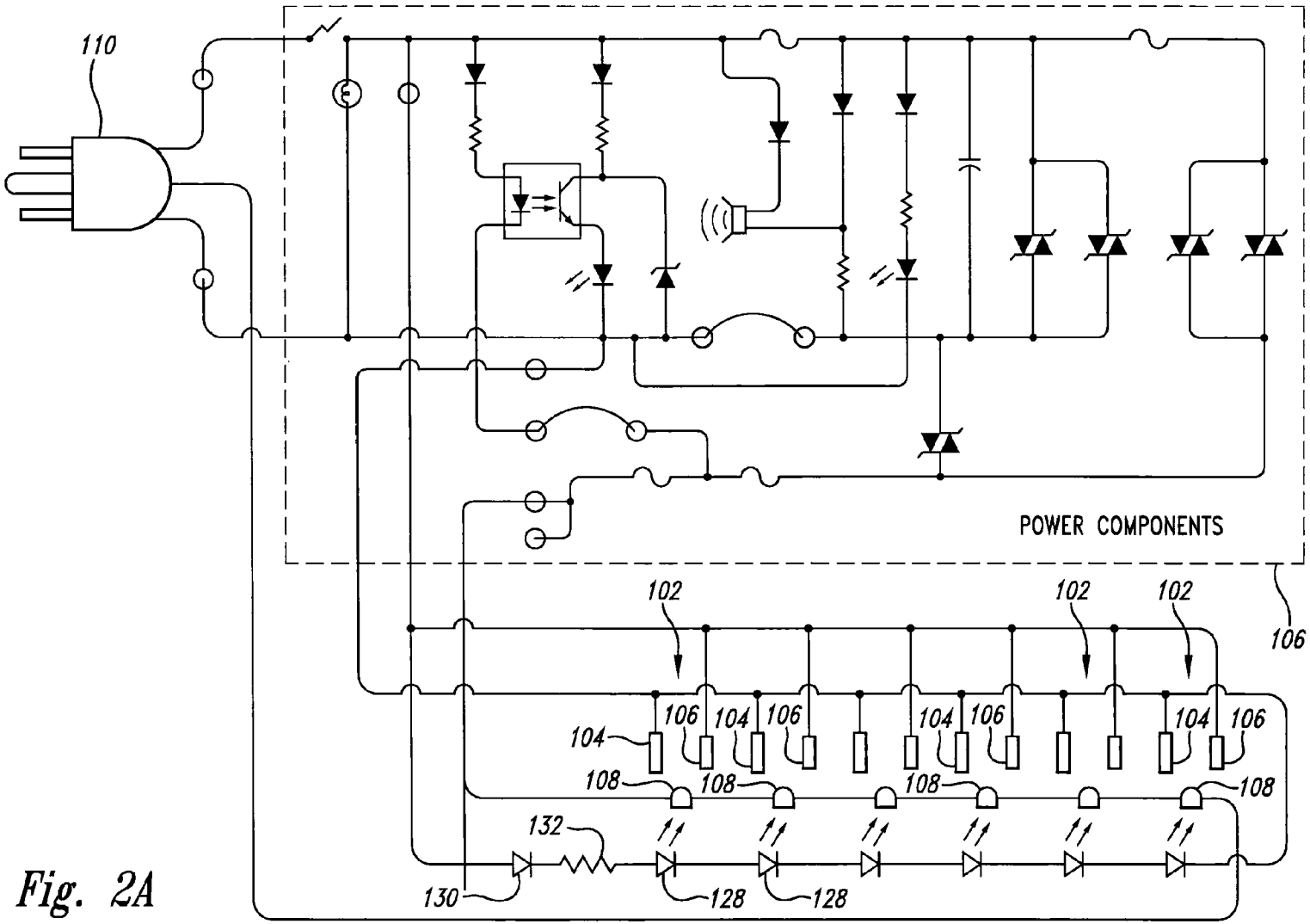
FIG. 2A is a schematic diagram of a particular version of the outlet system of FIG. 2 showing one implementation of the power components.

Components, both external and internal, of the outlet system 100, are represented schematically in FIG. 2 to include the supply cable 110 (shown with its plug), the plurality of outlets 102, power components 126, a plurality of light emitters 128, a regulating diode 130, and a regulating resistor 132. The power components 126 are provided for power conditioning and are otherwise involved with supplying electrical power to the outlets 102 as received through the supply cable 110. A particular implementation for the power components 126 is shown in FIG. 2A and other implementations can also be used. The light emitters 128 are shown in a one to one association with outlets 102 such that a different one of the light emitters is paired with a different one of the outlets.

In other implementations, other associations can be used such as one of the light emitters being associated with more than one of the outlets (one to many association), or more than one of the light emitters being associated with one of the outlets (many to one association), or other combinations thereof. Although the light emitters 128 are schematically depicted as being light emitting diodes, in other implementations, other devices that emit light can be used. The regulating diode 130 and regulating resistor 132 are provided to adjust electrical conditions to match requirements of the light emitters 128.

Figure 3:
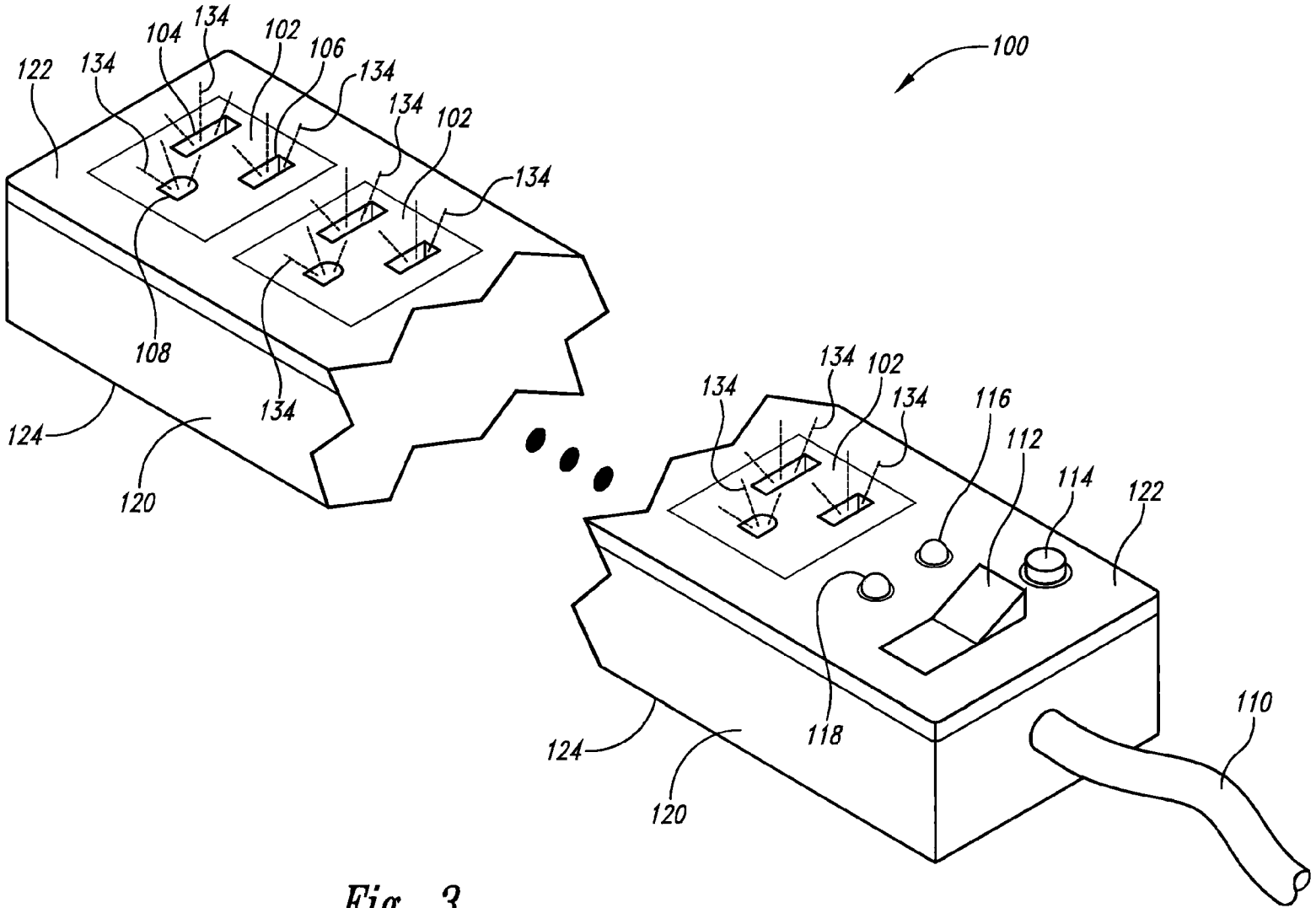
FIG. 3 is an enlarged partial front perspective view of the outlet system of FIG. 1 in a lit condition.

As shown in FIG. 3, when the power switch 112 is in the on position, the light emitters 128, positioned inside the interior of the housing 120 are energized to emit light. A portion of the emitted light is allowed to escape from the interior of the housing 120 through the neutral aperture 104, the positive aperture 106, and the ground aperture 108 of each of the outlets 102 to attract the attention of a sighted observer positioned in the vicinity of outlet system 100. By allowing a portion of the emitter light to shine through the apertures, the apertures are more clearly visible to an observer to assist the observer in guiding the prongs of a plug for engagement with one of the outlets 102.

Figure 4:
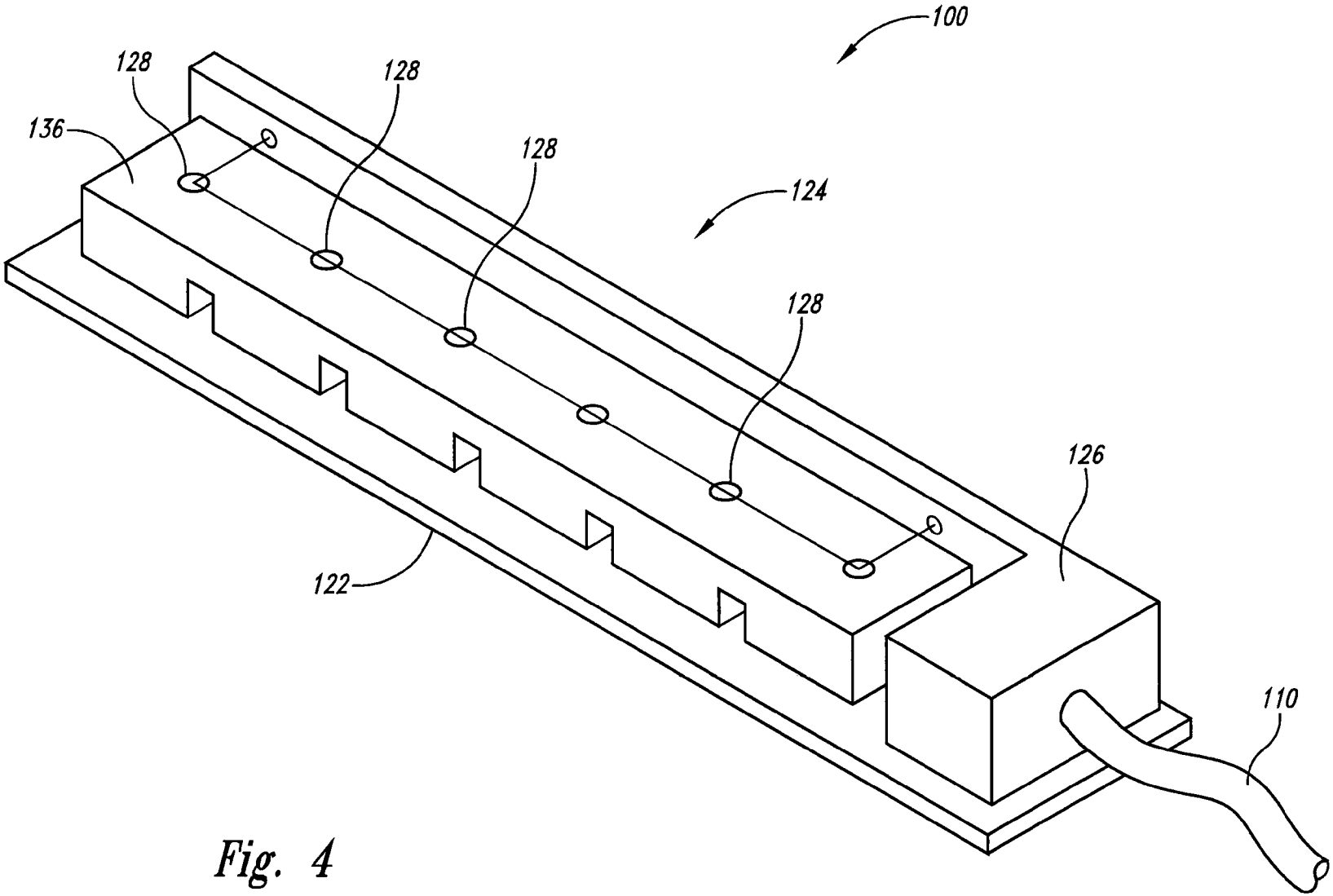
FIG. 4 is a back perspective view of the outlet system of FIG. 1.

As shown in FIG. 4, a terminal carrier section 136 is generally located on the backside of the outlet system 100 to among other things physically support and retain the light emitters 128 in predetermined positions advantageous to directing at least a portion of light emitted therefrom to the respective one of the outlets 102 for each of the light emitters. In some implementations, the terminal carrier section 136 can be removably attached to a portion of the housing and to the remainder of the outlet system 100 to allow for ready access to the interior of the housing 120 for servicing of the power components 126 and/or the light emitters 128.

Figure 5:
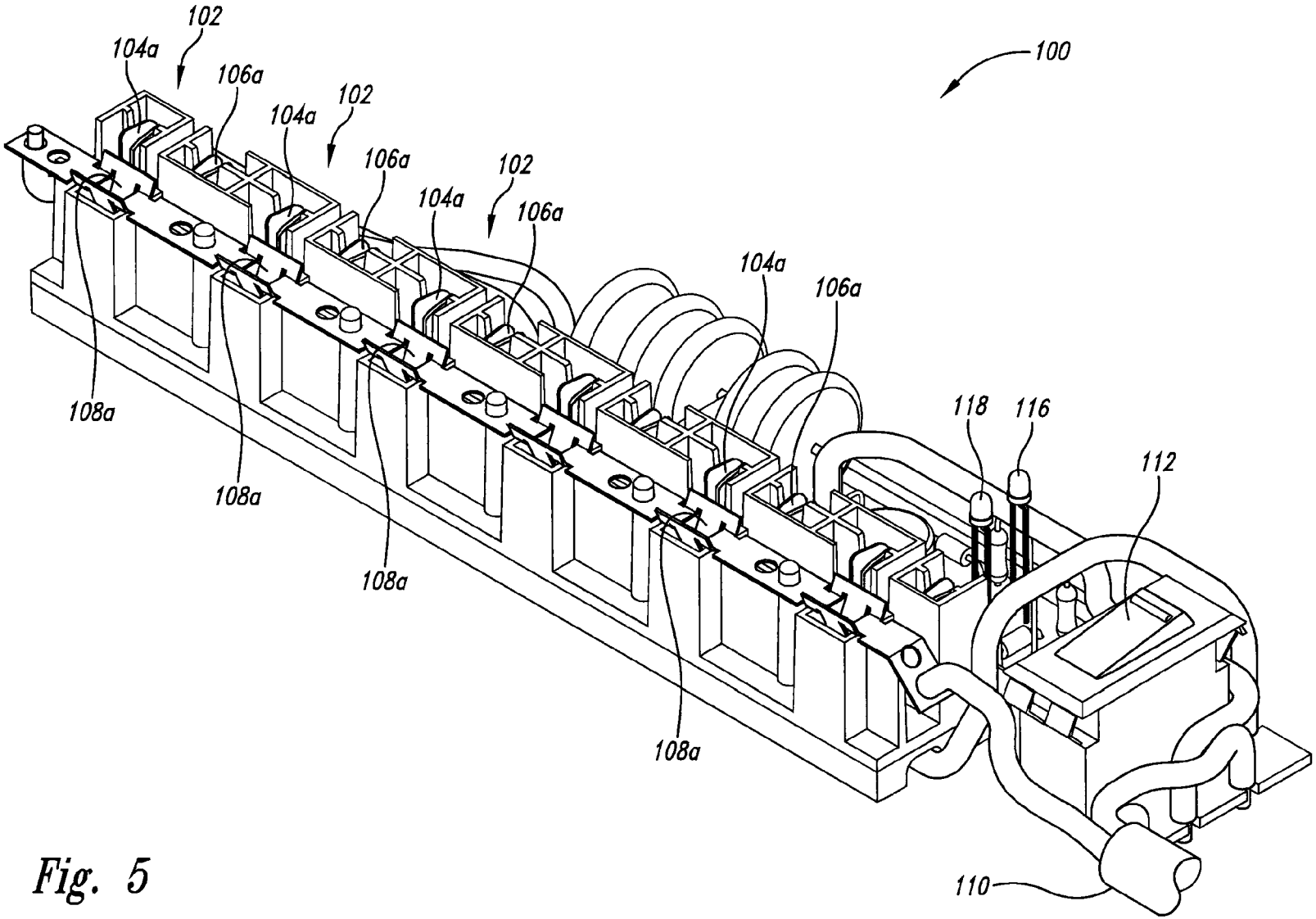
FIG. 5 is a front perspective view of the outlet system of FIG. 1 with exterior housing removed.
Figure 6:
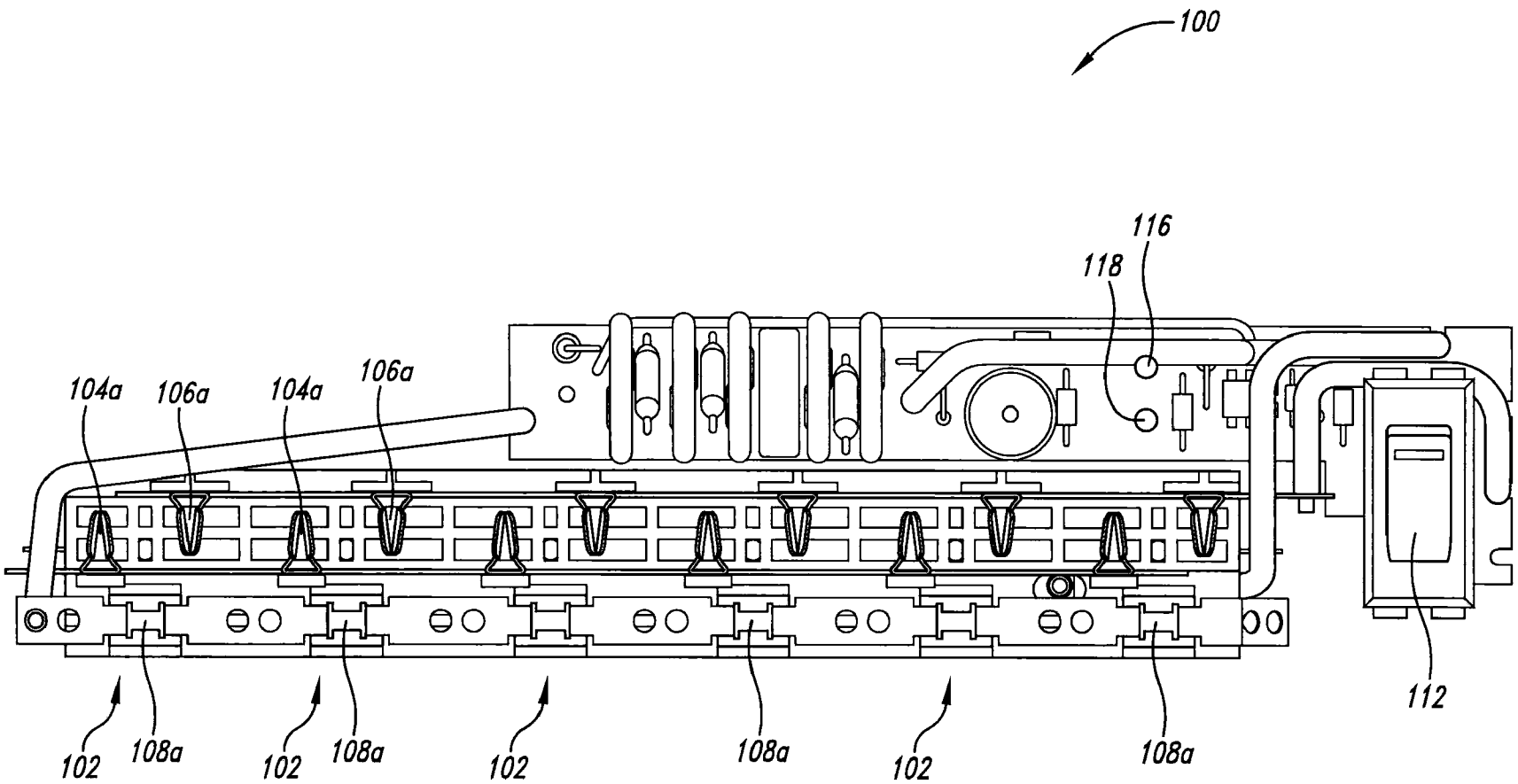
FIG. 6 is a front top view of the outlet system of FIG. 1 with exterior housing removed.
Figure 7:
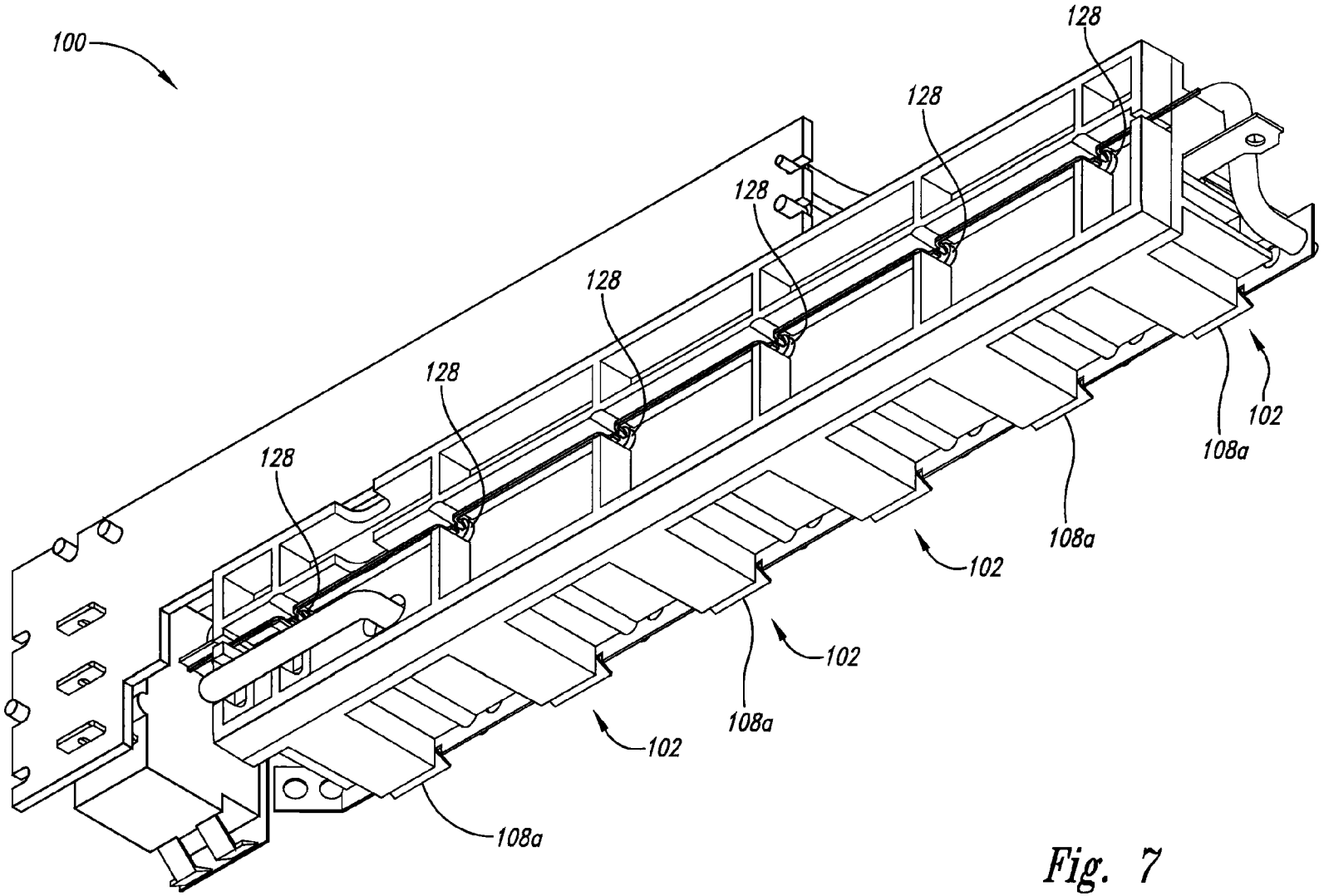
FIG. 7 is a back perspective view of the outlet system of FIG. 1 with exterior housing removed.

FIGS. 5-7 include views of the interior of the outlet system 100 with the housing 120 having been removed. Each of the outlets 102 includes a neutral terminal 104*a* (aligned and associated with the neutral aperture 104 to receive the neutral prong of a plug), a positive terminal 106*a* (aligned and associated with the positive aperture 104 to receive the positive prong of a plug), and a ground terminal 108*a* (aligned and associated with the ground aperture 104 to receive the ground prong of a plug) with a different one of the light emitters 128 positioned therebetween (as better shown in FIG. 6).

By such positioning, a single one of the light emitters 128 is able to project emitted light through the neutral aperture 104, the positive aperture 106 and the ground aperture 108 of an associated one of the outlets 102 thereby reducing the number of light emitters that might otherwise be needed for a desired level of exterior illumination through the apertures of the outlet. As mentioned above, other implementations may have other numbers of the light emitters 128 associated with numbers of the outlets 102 with consequential varying of positioning of the light emitters with respect to the neutral terminal 104*a*, the positive terminal 106*a*, and the ground terminal 108*a* of one or more of the outlets.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A system for use with an electrical plug having a neutral plug prong, a positive plug prong, and a ground plug prong, the system comprising:

a housing having an interior and an exterior;

a plurality of outlets coupled with the housing, each outlet having a non-light transmitting portion surrounding a neutral terminal aperture configured to receive the neutral plug prong of the electrical plug, a non-light transmitting portion surrounding a positive terminal aperture configured to receive the positive plug prong of the electrical plug, and a non-light transmitting portion surrounding a ground terminal aperture configured to receive the ground plug prong of the electrical plug; and a plurality of light emitters positioned in the interior of the housing to, when energized, emit light through the neutral terminal aperture, the positive terminal aperture, and the ground terminal aperture of each of the plurality of outlets from the interior of the housing to the exterior of the housing, the light to be visible from the exterior of the housing, the non-light transmitting portions of the plurality of outlets preventing the light emitted by the plurality of light emitters from passing therethrough thereby defining a non-illuminated portion about each of the neutral terminal aperture, the positive terminal aperture, and the ground terminal aperture.

2. The system of claim 1 wherein the plurality of light emitters are light emitting diodes.

3. The system of claim 1 wherein each of the plurality of outlets has a neutral terminal associated with the neutral terminal aperture, a positive terminal associated with the positive terminal aperture, and a ground terminal associated with the ground terminal aperture, and a different one of the plurality of light emitters is positioned between the neutral, positive, and ground terminals.

4. The system of claim 1 wherein each of the plurality of light emitters is positioned to emit light through the neutral, positive, and ground terminal apertures of a different one of the plurality of outlets.

5. The system of claim 1 further including a power switch electrically coupled with the plurality of light emitters to control energizing of the plurality of light emitters and of the plurality of outlets, the power switch having an on position and an off position.

6. The system of claim 5 wherein when the power switch is in the off position, electrical power is prevented from energizing the plurality of light emitters and is prevented from being made available to the plurality of outlets.

7. The system of claim 1 further including power components configured to condition electrical power prior to being supplied to the plurality of outlets.

8. The system of claim 1 wherein the plurality of outlets and the plurality of light emitters are in a one to one association.

9. The system of claim 1 wherein the plurality of outlets and the plurality of light emitters are in a many to one association.

10. The system of claim 1 wherein the plurality of outlets and the plurality of light emitters are in a one to many associations.

11. The system of claim 1 further including a carrier section removably attached to a portion of the housing and wherein the plurality of light emitters are coupled to the terminal carrier section.

12. A system for use with an electrical plug having a neutral prong, a positive prong, and a ground prong, the system comprising:

a housing having an interior and an exterior;

an outlet coupled with the housing, the outlet having a non-light transmitting portion, a neutral aperture formed in the non-light transmitting portion, a positive aperture formed in the non-light transmitting portion, and a ground aperture formed in the non-light transmitting portion, the neutral aperture being configured to receive the neutral prong of the electrical plug, the positive aperture being configured to receive the positive prong of the electrical plug, and the ground aperture being configured to receive the ground prong of the electrical plug; and a light emitter positioned in the interior of the housing to emit light from the interior of the housing through the neutral, positive, and ground apertures to the exterior of the housing, the non-light transmitting portion defining a contrasting unlit portion around each of the neutral, positive, and ground apertures when light is emitted therethrough.

13. The system of claim 12 wherein the light emitter is a light emitting diode.

14. The system of claim 12 wherein the outlet has a neutral terminal associated with the neutral aperture, a positive terminal associated with the positive aperture, and a ground terminal associated with the ground aperture, and the light emitter is positioned between the neutral, positive, and ground terminals.

15. The system of claim 12 further including a power switch electrically coupled with the light emitter to control energizing of the light emitter and of the outlet, the power switch having an on position and an off position.

16. The system of claim 15 wherein when the power switch is in the off position, electrical power is prevented from energizing the light emitter and is prevented from being made available to the outlet.

17. The system of claim 12 further including power components configured to condition electrical power prior to being supplied to the outlet.

18. The system of claim 12 wherein the outlet and the light emitter are in a one to one association.

19. The system of claim 12 further including a carrier section removably attached to a portion of the housing and wherein the light emitter is coupled to the terminal carrier section.

20. A method comprising:

providing a housing having an interior and an exterior;

coupling a plurality of outlets with the housing, each outlet having a neutral aperture, a positive aperture, and a ground aperture formed in a non-light transmitting outer surface, the neutral aperture being configured to receive a neutral prong of an electrical plug, the positive aperture being configured to receive a positive prong of the same electrical plug, and the ground aperture being configured to receive a ground prong of the same electrical plug; and positioning a plurality of light emitters in the interior of the housing to, when energized, emit light from the interior of the housing through the neutral, positive, and ground apertures of each of the outlets to the exterior of the housing, the light emitted through the neutral, positive, and ground apertures of each of the plurality of outlets being visible from the exterior of the housing, the non-light transmitting outer surfaces of the plurality of outlets preventing the transmission of light therethrough to define an unlit region about each of the neutral, positive, and ground apertures of each of the plurality of outlets.

21. The method of claim 20 wherein the plurality of light emitters are light emitting diodes.

22. The method of claim 20 wherein each of the plurality of outlets has a neutral terminal associated with the neutral aperture, a positive terminal associated with the positive aperture, and a ground terminal associated with the ground aperture, and a different one of the plurality of light emitters is positioned between the neutral, positive, and ground terminals.

23. The method of claim 20 wherein each of the plurality of light emitters is positioned to emit light through the neutral, positive, and ground apertures of a different one of the plurality of outlets.

24. The method of claim 20 further including providing a power switch electrically coupled with the plurality of light emitters to control energizing of the plurality of light emitters and of the plurality of outlets, the power switch having an on position and an off position.

25. The method of claim 24 further including when the power switch is in the off position, preventing electrical power from energizing the plurality of light emitters and preventing electrical power from being made available to the plurality of outlets.

26. The method of claim 20 further including providing power components configured to condition electrical power prior to being supplied to the plurality of outlets.

27. The method of claim 20 wherein the plurality of outlets and the plurality of light emitters are provided in a one to one association.

28. The method of claim 20 wherein the plurality of outlets and the plurality of light emitters are provided in a many to one association.

29. The method of claim 20 wherein the plurality of outlets and the plurality of light emitters are provided in a one to many associations.

30. The method of claim 20 further including providing a carrier section removably attached to a portion of the housing and coupling the plurality of light emitters to the terminal carrier section.

31. A system for use with an electrical plug having a neutral plug prong, a positive plug prong, and a ground plug prong, the system comprising:

a non-light transmitting housing with an interior portion;

a plurality of outlets coupled with the housing, each outlet being non-light transmitting and having a neutral terminal aperture configured to receive the neutral plug prong of the electrical plug, a positive terminal aperture configured to receive the positive plug prong of the electrical plug, and a ground terminal aperture configured to receive the ground plug prong of the electrical plug; and a plurality of light emitters positioned inside the interior portion of the housing to emit light through each of the neutral, positive, and ground terminal apertures of each of the plurality of outlets, the light emitted to be visible from outside the housing as a plurality of spaced apart discrete light sources each corresponding to one of the neutral, positive, and ground terminal apertures of one of the plurality of outlets.

* * * * *